US005478282A

United States Patent [19]

Possum et al.

[11] Patent Number: 5,478,282

[45] Date of Patent: Dec. 26, 1995

[54] POOL CUE AND SLIDE

[76] Inventors: Jerry G. Possum, 5 Miller Rd., Vernon, Conn. 06066; Robert A. Hayward, 126C Highland St., Manchester, Conn. 06040

[21] Appl. No.: 300,976

[22] Filed: Sep. 6, 1994

[51] Int. Cl.[6] ..... A63D 15/08

[52] U.S. Cl. ..... 473/48

[58] Field of Search ..... 473/2, 42, 43, 473/44, 45, 46

[56] References Cited

U.S. PATENT DOCUMENTS

| | | | |
|---|---|---|---|
| 870,491 | 11/1907 | Callaghan | 473/43 |
| 4,290,030 | 9/1981 | Medbury | 473/2 |
| 5,238,457 | 8/1993 | Triplett | 473/42 |

FOREIGN PATENT DOCUMENTS

| | | | |
|---|---|---|---|
| 523666 | 8/1921 | France | 473/42 |
| 528583 | 11/1921 | France | 473/42 |

*Primary Examiner*—Theatrice Brown

*Attorney, Agent, or Firm*—McCormick, Paulding & Huber

[57] ABSTRACT

A pool or billiard cue has a slender elongated and gradually tapered configuration throughout a major portion of its length but also has a front end portion of substantial length and which is of uniform diameter throughout its length. A tubular sleeve fits closely about the front end portion but is freely slideable relative thereto and therealong. The sleeve is engageable manually by a pool or billiard player with his bridge hand to facilitate and control the linear movement of the pool cue and to thus provide for a smooth and highly accurate stroke and shot with minimal friction.

10 Claims, 1 Drawing Sheet

POOL CUE AND SLIDE

BACKGROUND OF THE INVENTION

A technique which is fundamental and yet probably the most difficult to learn and master in games of pool and billiards is the proper support and guidance of the pool or billiard cue with the "bridge" hand of the player. The cue must be held securely enough to prevent unintended or incidental movement in a lateral or other direction, which movement might detrimentally affect the aim of the player, when the player is causing the cue to be urged linearly forwardly toward the cue ball and, most particularly, at the point of impact with the ball. On the other hand, the cue must be held in such manner as to accommodate a smooth sliding action and an unimpeded stroke toward the ball. While it would be difficult to manually guide and control a cue with a uniform diameter it will be quite obvious that it is even more difficult to guide and control the conventional elongated cue of a tapered configuration. Still further, a player's hand does not always form an ideal sliding surface for a pool cue. When, for example, a player's hand is damp, as with perspiration, it may become extremely difficult to provide a smooth and accurate stroke and shot. These difficulties obviously detract from the enjoyment which a beginner receives from playing and may also retard his progress and development of skill in other aspects of the game. Similarly, enhanced ease and convenience of use and improved accuracy are of great value even to the expert player.

Various devices have herebefore been available for use with a player's bridge hand but have not been wholly satisfactory.

It is the general object of the present invention to provide a slideable sleeve for manual engagement by the bridge hand of a pool or billiard player and which is freely moveable along a unique pool or billiard cue to closely and accurately guide and control the movement of the cue and to thus facilitate a smooth and precise stroke and shot, the sleeve and cue shaft being a matched set.

SUMMARY OF THE INVENTION

In fulfillment of the foregoing object and in accordance with the present invention, a conventional pool or billiard cue is provided with a slender elongated and gradually tapered configuration throughout a major portion of its length. At a front end portion of substantial length, however, the pool or billiard cue is provided with a uniform diameter and a tubular sleeve is custom fitted closely thereabout but is freely slideable relative thereto and therealong. The sleeve is engageable manually by a pool or billiard player with his bridge hand to facilitate and control the linear movement of the pool cue and thus to provide for a smooth and highly accurate stroke and shot, with minimum friction.

Preferably, the front end portion of the pool cue is between 10 and 30 inches long, and approximately 21 inches long.

The sleeve is approximately 4 inches long in the presently preferred embodiment of the invention but may fall in the range of 3 to 8 inches in length and even in the range of 2 to 10 inches long.

Preferably, the sleeve has an inside diameter 0.004 to 0.014 inches larger than the outside diameter of the front end portion of the pool cue and the sleeve has a wall thickness of 0.050±0.004 inches.

Finally, the rear end portion of the uniform diameter front end portion of the pool cue is designed with a slightly enlarged diameter whereby to cause binding of the sleeve thereon when the sleeve is moved to its rearwardmost position and thereby to lock and hold the sleeve in a fixed position relative to the pool cue. This is desired for play when the sleeve is not used.

DESCRIPTION OF THE PREFERRED EMBODIMENT

Figure 1:
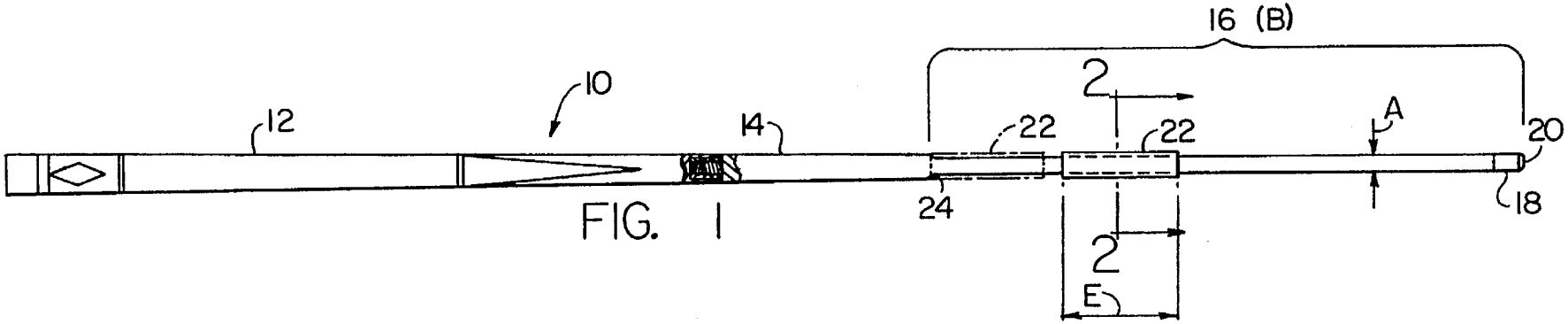
FIG. 1 is a side view of a slender elongated pool cue and slide of the present invention.
Figure 2:
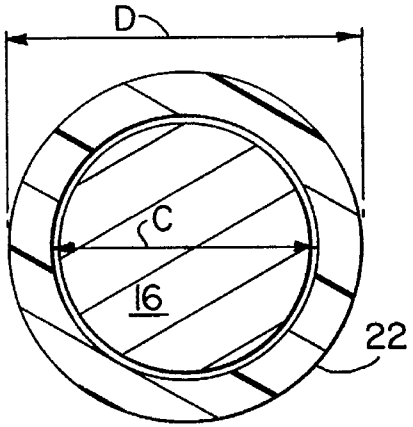
FIG. 2 is an enlarged cross-sectional view taken generally as indicated at 2,2 in FIG. 1.

Referring now to the drawings and particularly to FIG. 1, a pool or billiard cue shown therein generally at 10 has a left hand or rear portion 12 which is usually about 29 inches long. The rear or "butt" portion 12 may have a decorative finish, for example, an inlay of different kinds of wood etc. Joined to and extending forwardly from the butt section 12 of the cue is a "shaft" or forward portion 14 which is usually of a plain finish with a tapered diameter. The forward or shaft and the butt portion are usually connected together with a screw joint comprising male and female screw sections formed integrally or otherwise affixed to the sections. With the two parts connected together the cue stick normally measures about 58 inches in length. Select rock maple and other like materials are employed in the manufacture of pool and billiard cues.

The pool or billiard cue of FIG. 1 also has a front end portion 16 of the shaft 14 which is of a reduced and uniform diameter throughout its length. Preferably the shaft 14, including the front end portion 16 thereof is finished in a hard smooth surface and may be highly polished. At a terminal end portion of the front end portion 16 a ferrule 18 and leather tip 20 may be provided in conventional manner.

A sleeve 22 mounted on and slideable along the front end portion 16 may be of PVC/phynolic composition or the like and is preferably about 4 inches long. The sleeve may, however, fall in the range of 3 to 8 inches in length and even the range 2 to 10 inches in length. Preferably, the sleeve has an inside diameter 0.004 to 0.014 inches larger than the diameter of the front end portion 16. At a rear end portion 24 the front end portion 16 is slightly enlarged diametrically to frictionally bind the sleeve in position when desired.

The following chart shows the various dimensions for a presently preferred form of the cue and sleeve. With the relative dimensions illustrated, a highly efficient pool and billiard cue and sleeve combination is provided. A smooth and accurate stroke can be achieved by both beginners and experts alike and the accuracy of the ensuing shot is greatly enhanced.

| | DIMENSIONS | | |
|---|---|---|---|
| | CUE STICK SHAFT SIZE # | | |
| | 12 MM | 13 MM | 14 MM |
| A | 0.472"<br>+.000"<br>−.004" | 0.512"<br>+.000"<br>−.004" | 0.551"<br>+.000"<br>−.004" |

-continued

| | DIMENSIONS | | |
|---|---|---|---|
| | CUE STICK SHAFT SIZE # | | |
| | 12 MM | 13 MM | 14 MM |
| B | 21" ±2" | 21" ±2" | 21" ±2" |
| C | 0.480" ±.004" | 0.520" ±.004" | 0.559" ±.004" |
| D | 0.580" ±.005" | 0.620" ±.008" | 0.659" ±.008" |
| E | 4" to 8" | 4" to 8" | 4" to 8" |

We claim:

1. In combination, a pool cue having a slender elongated and gradually tapered configuration throughout a major portion of its length and a front end portion of substantial length and of substantially uniform diameter throughout its length, and a tubular sleeve fitting closely about said front end portion of said pool cue but freely slideable relative thereto and therealong, said sleeve being engageable manually by a pool or billiard player with his bridge hand to facilitate and control linear movement of the pool cue and to thus provide for a smooth and highly accurate stroke and shot with minimum friction, and a terminal rear end portion of the uniform diameter front end portion being of a slightly enlarged diameter whereby to cause binding of the sleeve thereon when the sleeve is moved to its rearwardmost position and thereby to frictionally hold the sleeve in a fixed position relative to the pool cue.

2. In the combination of a pool cue and sleeve as set forth in claim 1 wherein the front end portion of the pool cue is between 10 and 30 inches long.

3. In the combination of a pool cue and sleeve as set forth in claim 2 wherein the front end portion of the pool cue is between 20 and 22 inches long.

4. In the combination of a pool cue and sleeve as set forth in claim 3 wherein the front end portion of the pool cue is approximately 21 inches long.

5. In the combination of a pool cue and sleeve as set forth in claim 1 wherein the sleeve is between 2 and 10 inches long.

6. In the combination of a pool cue and sleeve as set forth in claim 5 wherein the sleeve is between 4 and 8 inches long.

7. In the combination of a pool cue and sleeve as set forth in claim 6 wherein the sleeve is approximately 4 inches long.

8. In the combination of a pool cue and sleeve as set forth in claim 1 wherein the sleeve has a diameter of 0.004 to 0.014 inches larger than the front end portion of the pool cue.

9. In the combination of a pool cue and sleeve as set forth in claim 8 wherein the sleeve has a diameter 0.110±0.006 inches larger than the front end portion of the pool cue.

10. In the combination of a pool cue and sleeve as set forth in claim 9 wherein the sleeve has a wall thickness of 0.050±0.004 inches throughout its length, and wherein the sleeve is made of one of a group of materials including PVC, phynolic, plaster, metal etc. and engraved and colored as desired.

* * * * *